United States Patent [19]

Dominguez

[11] Patent Number: 4,552,395

[45] Date of Patent: Nov. 12, 1985

[54] COLLAPSIBLE WEDGE FOR SLIDING DOORS AND WINDOWS

[76] Inventor: Edward J. Dominguez, 503 Park Ave., San Jose, Calif. 95110

[21] Appl. No.: 715,763

[22] Filed: Mar. 25, 1985

Related U.S. Application Data

[63] Continuation of Ser. No. 297,245, Aug. 28, 1981, abandoned.

[51] Int. Cl.[4] ..... E05C 17/44; E05C 17/54

[52] U.S. Cl. ..... 292/342; 292/229; 292/DIG. 46

[58] Field of Search ..... 292/342, 343, DIG. 46, 292/229, 338, 265

[56] References Cited

U.S. PATENT DOCUMENTS

| | | | |
|---|---|---|---|
| 222,998 | 12/1879 | Mann | 292/229 |
| 478,471 | 7/1892 | Schenck | 292/338 X |
| 701,431 | 6/1902 | Watts | 292/343 |
| 1,042,329 | 10/1912 | Daniels | 292/343 |
| 1,338,205 | 4/1920 | Albright | 292/343 |
| 1,555,129 | 9/1925 | Lipsius | 292/343 |
| 1,633,202 | 6/1927 | Williams | 292/343 |
| 2,353,953 | 7/1944 | Dilks | 292/342 |
| 2,825,597 | 3/1958 | Richmond | 292/343 |
| 4,015,867 | 4/1977 | Siden | 292/338 X |
| 4,054,308 | 10/1977 | Prohaska | 292/DIG. 46 X |
| 4,105,233 | 8/1978 | Levey | 292/DIG. 46 X |
| 4,114,936 | 9/1978 | Dominguez | 292/342 |
| 4,208,841 | 6/1980 | Starks | 292/343 X |
| 4,248,461 | 2/1981 | Stevens | 292/265 X |

FOREIGN PATENT DOCUMENTS

| | | | |
|---|---|---|---|
| 1464119 | 11/1966 | France | 292/DIG. 46 X |

*Primary Examiner*—Gary L. Smith
*Assistant Examiner*—Russell W. Illich
*Attorney, Agent, or Firm*—John J. Leavitt

[57] ABSTRACT

A security device characterized by a base which attaches to the top of an upper track of a sliding door or window, a wedging member having an end pivotally attached to the base, a spring biasing the wedging member towards the base, and a propping member having an end pivotally attached to the base and movable, under the influence of gravity, to an overcenter position to retain the wedging member in an open, wedging position. When closed, the device fits within the space between the top of the sliding door or window and the top of the upper track of the door or window, and when open the device prevents or limits the opening of the sliding door or window.

9 Claims, 15 Drawing Figures

COLLAPSIBLE WEDGE FOR SLIDING DOORS AND WINDOWS

This application is a continuation of application Ser. No. 297,245, filed Aug. 28, 1981 now abandoned.

BACKGROUND OF THE INVENTION

1. Field of the Invention

This invention relates generally to door and window wedges and more particularly to wedge stops for sliding closures.

2. Description of the Prior Art

The use of wedge stops for doors and windows is well known in the prior art. For example, in U.S. Pat. No. 1,338,205 of Albright an adjustable door check is described including a bifurcated wedge provided with a screw for adjusting the height of the wedge.

A number of prior art patents disclose wedges which attach to or near a door or window. Such wedges have many advantages over unattached wedges, including a potentially greater stopping power than an unattached wedge, which might slip. Some wedges attach to a surface over which the door or window must open, and thus can be used to limit, rather than prevent, the opening of the door or window.

An example of a wedge which attaches to the floor, side wall, or ceiling adjacent to the door is found in U.S. Pat. No. 4,114,936 of Dominquez. In that patent, Dominquez describes a device including a pair of elongated, nestling channel members pivotally attached together at their ends, a prop member pivotally attached to a lower one of the channel members, and a screw coupled to the upper channel member. When the prop member is raised and engaged with the retaining screw the upper channel member is retained in an inclined, wedging position. Wedges have also been used to prevent or limit the opening of a sliding door or window. For example, in U.S. Pat. No. 4,208,841 Starks describes a stop assembly including a wedge removably secured with a VELCRO TM fastener to a sliding door assembly. A problem that Starks does not address is how to conveniently position a wedge near the top of a sliding door assembly where it is least detectable and most effective.

In U.S. Pat. No. 4,105,233 Levey describes a window and door lock including a pair of S shaped rod members coupled together at their ends. The free ends of the rod members are disposed within the space between the top of a sliding door or window, and the top of the upper track along which door or window is guided. The angles of the rod members are designed to allow the door or window to be partially opened. A problem with Levey's device is that it is not easy to install or remove, particularly for shorter persons.

It might be possible to install a version of Dominquez's collapsible wedge of U.S. Pat. No. 4,114,936 near the top of a sliding door or window, but some problems would arise. For one, the inverted wedging member would have a tendency to pivot under the influence of gravity to its wedging position and thus would interfere with the normal opening and closing of the door or window. Furthermore, Dominquez's wedge would be difficult to open and close when attached near the top of a sliding door or window since the retaining screw must be engaged with the prop to keep the wedge in an operational position.

What the prior art fails to disclose, then, is a wedge that can attach near the top of sliding doors and windows and which is easy to open and close by a person standing at ground level.

SUMMARY OF THE INVENTION

It is a major object of this invention to provide a collapsible wedge particularly adapted to attach near the top of a sliding door or window.

A further object of this invention is to provide such a wedge that is easy to open and close from ground level, even for a shorter person.

An object of one embodiment of this invention is to provide a wedge device which allows a sliding door or window to be wedged either in a closed or in a partially open position.

Briefly, the invention includes an elongated base attached to the top of the upper track of a sliding door or window, a wedging member having an end pivotally attached to the base, a spring biasing the wedging member towards the base, and a prop member pivotally attached to the base and pivotable to an overcenter propping position where it retains the wedging member in an open, wedging position. To open the device the free end of the wedging member is pulled down so that the prop member can, under the influence of gravity, pivot to its overcenter position. To close the device, the prop member is tapped away from its overcenter position and the spring forces the wedging member and prop into engagement with the base.

An embodiment of this invention includes a second wedging member spaced from the first wedging member and pivotally attached to the base, a second spring biasing the second wedging member towards the base, and a second propping member for retaining the wedging member in an open, wedging position. The first wedging member can hold the sliding door or window closed, and the second wedging member allows the sliding door or window to partially open.

An advantage of this invention is that the top of a sliding door or window can be safely and inconspicuously wedged.

Another advantage of this invention is that the collapsible wedge is easily opened and closed by a person standing at ground level.

Yet another advantage of an embodiment of this invention is that a sliding door or window can either be wedged shut or in a partially open position.

These and other objects and advantages of the present invention will no doubt become apparent upon a reading of the following descriptions and a study of the several figures of the drawing.

DETAILED DESCRIPTION OF THE PREFERRED EMBODIMENT(S)

Figure 5:
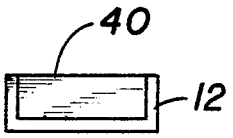
FIG. 5 is a left end elevational view of FIG. 4.
Figure 4:
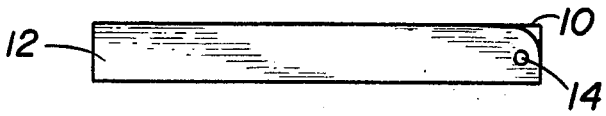
FIG. 4 is a front elevational view of the first embodiment in its closed position.
Figure 3:
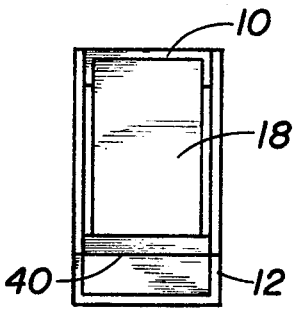
FIG. 3 is a left end elevational view of FIG. 1.
Figure 1:
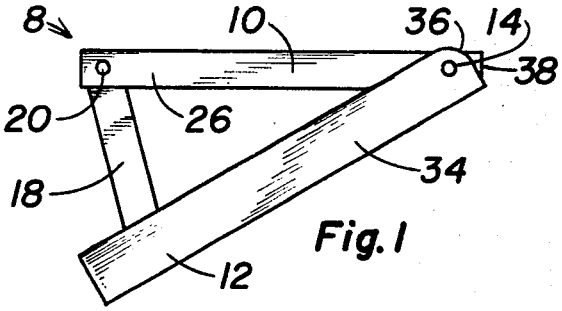
FIG. 1 is a front elevational view of a first embodiment of the present invention in its open, wedging position.
Figure 2:
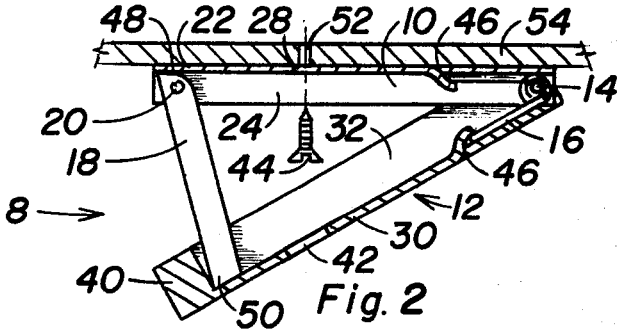
FIG. 2 is a partially cross-sectioned view of FIG. 1.

Referring to FIGS. 1-5, a collapsible wedge 8 in accordance with the present invention includes a base 10, a wedging member 12 attached to the base by a pivot pin 14, a spring 16 spiraled around the pivot pin and engaging the base and the wedging member, and a prop member 18 attached to the base by a pivot pin 20. The wedging member is movable between an open, propped position as shown in FIGS. 1-3, and a closed position as shown in FIGS. 4 and 5.

Base 10 is an elongated, channel shaped member having a web portion 22 and downwardly depending side wall portions 24 and 26. The base is preferably provided with one or more screw holes 28.

Wedging member 12 is also an elongated, channel shaped member, and includes a web portion 30 and upwardly extending side wall portions 32 and 34. Base 10 is designed to nestle within the wedging member. Pivot pin 14 is preferably press fit through bores provided in side wall portions 32 and 34, and extends through slightly larger bores provided in side wall portions 24 and 26 of the base member. The end 36 of member 12 is rounded so as not to interfere with the pivotal motion of the wedging member, and the end 38 of the base is configured to engage web portion 30 of the wedging member to limit its maximum opening.

The free end of the wedging member is provided with a stop portion 40. An aperture 42 may be provided in web portion 30 of the wedging member so that a screwdriver can access a screw 44 which attaches the base to the top of a sliding door or window track.

The ends of spring 16 engage tang portions 46 provided on the base and the wedging member. The spring is in extension so as to normally bias wedging member 12 towards the base member 10.

Prop member 18 has an upper end 48 partially rounded to allow the prop member to freely pivot, under the influence of gravity, to its overcenter position. The prop member also has a lower end 50 angled to fully abut web portion 30 when the wedging member 12 is in its open or wedging position. Stop portion 40 of the wedging member cooperates with the upper rounded end 48 to limit the overcenter position of the prop member.

To install the present device, a small hole 52 is drilled into the top 54 of the upper track of a sliding door or window. The location of this hole is determined by abutting the opened and propped wedging member against the upper corner of the door to eliminate the possibility of any movement of the door or window when the collapsible wedge lock is secured in place. A fastener such as sheet metal screw 44 is disposed through hole 28 of the base web and screwed into the top 54 of the track. The head of fastener 44 can be accessed through aperture 42 of the wedging member. Of course, the base is preferably provided with more than one screw hole so that the device can be attached to the top of the track with a plurality of screws.

Figure 6:
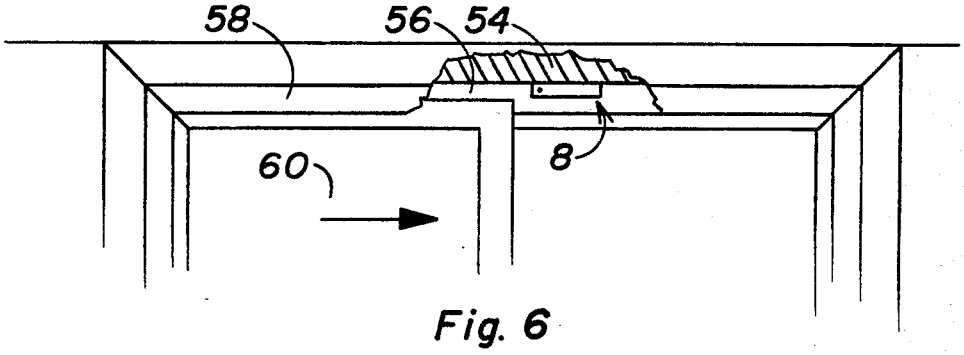
FIGS. 6 and 7 are operational views of the first embodiment.
Figure 7:
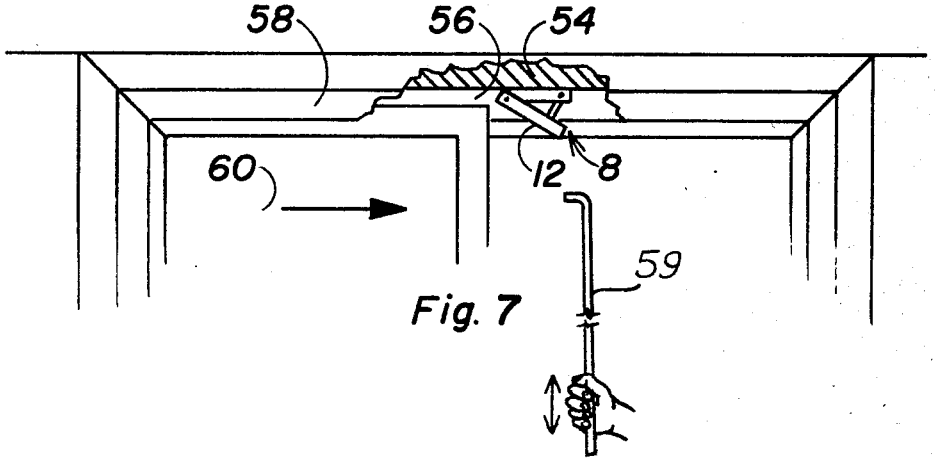
Figure 12:
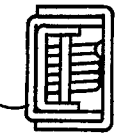
FIG. 12 is a right end elevational view of FIG. 11.
Figure 10:
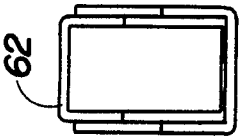
FIG. 10 is a right end elevational view of FIG. 8.
Figure 11:
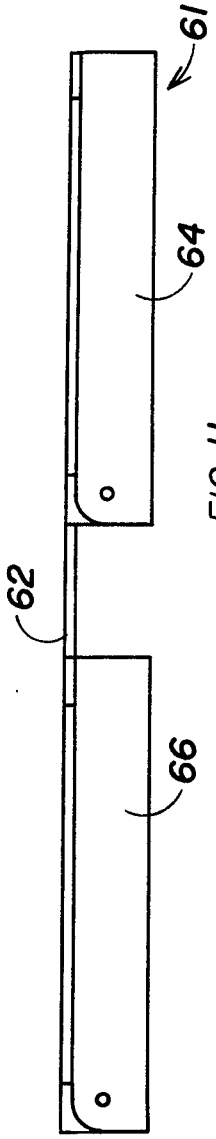
FIG. 11 is a front elevational view of the second embodiment in its closed position.
Figure 8:
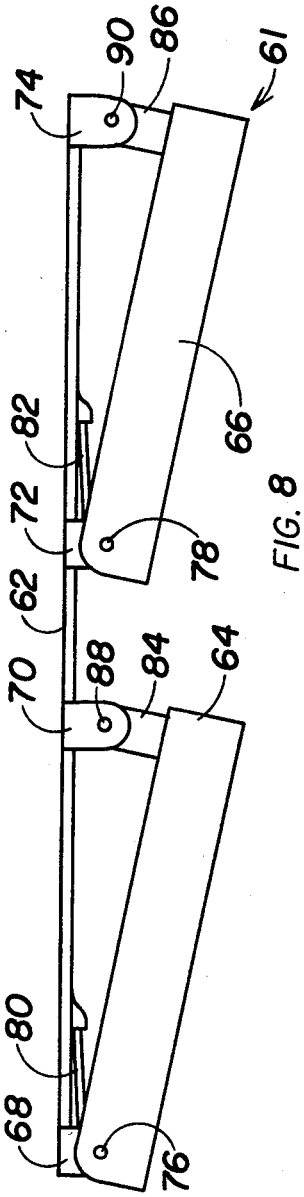
FIG. 8 is a front elevational view of a second embodiment of the present invention in its open, wedging positions.
Figure 9:
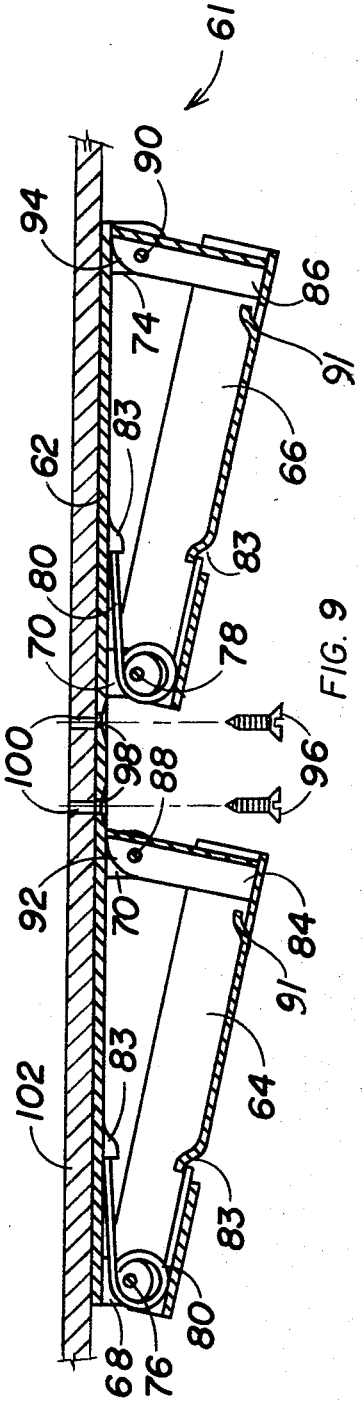
FIG. 9 is a partially cross-sectioned view of FIG. 8.

With reference to FIG. 6, it may be seen that there is a space 56 between the top 54 of the upper track 58 and the top of a sliding door or window 60. When the collapsible wedge 8 is in its closed position, as shown, the door 60 can be moved along track 60 without interference. As seen in FIG. 7, when the wedging member 12 is opened to its wedging position the collapsible wedge will limit or prevent the opening of door 60. It should of course be understood that any force exerted to open the door or window against the open wedging member will result in a component of force being exerted against the top of the door or window to prevent its being lifted from its track.

To open the collapsible wedge, the free end of the wedging member is pulled down against spring pressure until the propping member 18 swings, under the biasing influence of gravity, to its overcenter position in abutment with stop portion 40. To close the collapsible wedge the propping member is tapped, for example with a finger, ruler, or pencil, until it is no longer in its overcenter position at which time the spring will automatically close the device, i.e. pivot both the elongated wedging member and prop into collapsed position. An L shaped tool 59 can be optionally provided to facilitate the opening and closing of the wedge, as will be discussed in greater detail with reference to a second embodiment of this invention. It will be appreciated that the present device can be easily operated from ground level, even by a shorter person, because any elongated implement can be used to extend the reach of the person and open and close the device.

In FIGS. 8-12, a second embodiment 61 of the present invention is shown to include a base 62, and a spaced apart pair of wedging members 64 and 66. The base is an elongated strip having four pairs of depending ears 68, 70, 72, and 74 constituting side wall portions on the strip. Pivot pins 76 and 78 attach an end of wedging members 64 and 66 to ears 68 and 72, respectively. Coiled around pins 76 and 78 are springs 80 and 82, respectively, which engage tangs 83 of the base and the wedging members to bias the wedging members toward the base. Propping members 84 and 86 are pivotally attached to ears 70 and 74, respectively, by pivot pins 88 and 90, respectively. Locking tangs 91 are provided in members 64 and 66 to reduce the chance of accidental or unauthorized closing of the wedges.

In this embodiment, the wedging members are not provided with a stop similar to stop 40 in FIG. 2 for the propping members. As previously explained with respect to prop member 18, the ends 92 and 94 of the propping members 84 and 86 are contoured to engage base strip 62 when they have pivoted to their overcenter position. As shown, the propping members and the wedging members are preferably constructed from channel material.

To install this second embodiment, fasteners such as screws 96 are disposed through screw holes 98 provided in the base to engage bores 100 formed in the top 102 of a sliding door or window track. The wedging members are opened in a similar manner as in the previous embodiment, with the exception that they are pulled down sufficiently so that the propping members swing past the locking tangs 91. The locking tangs make it harder for a person to close the wedge by reaching through a partially open door or window. To close the wedges the wedging member must be simultaneously pulled down and the propping members urged away from their overcenter position.

Figure 13:
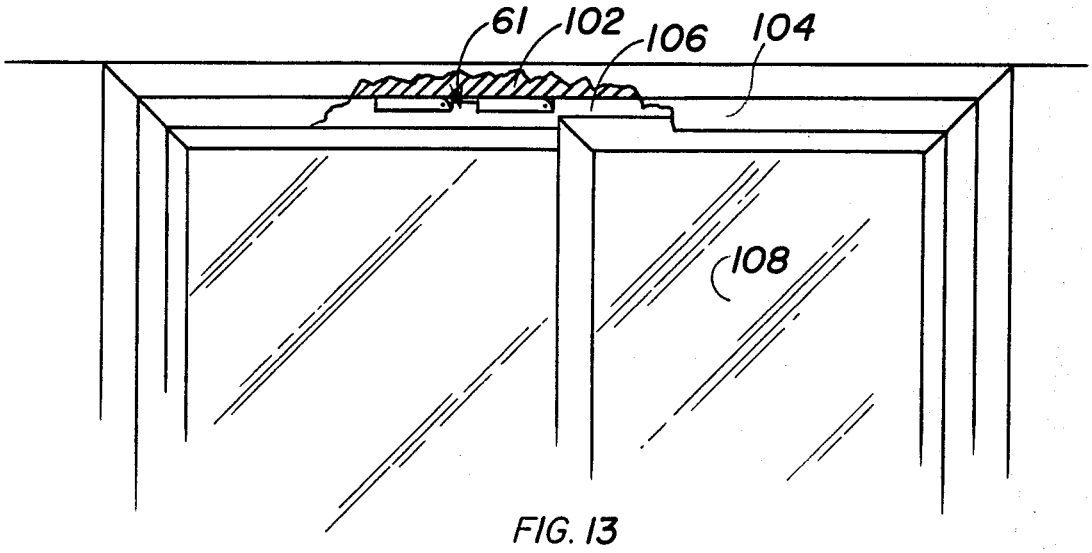
FIG. 13, 14, and 15 are operational views of the second embodiment.
Figure 14:
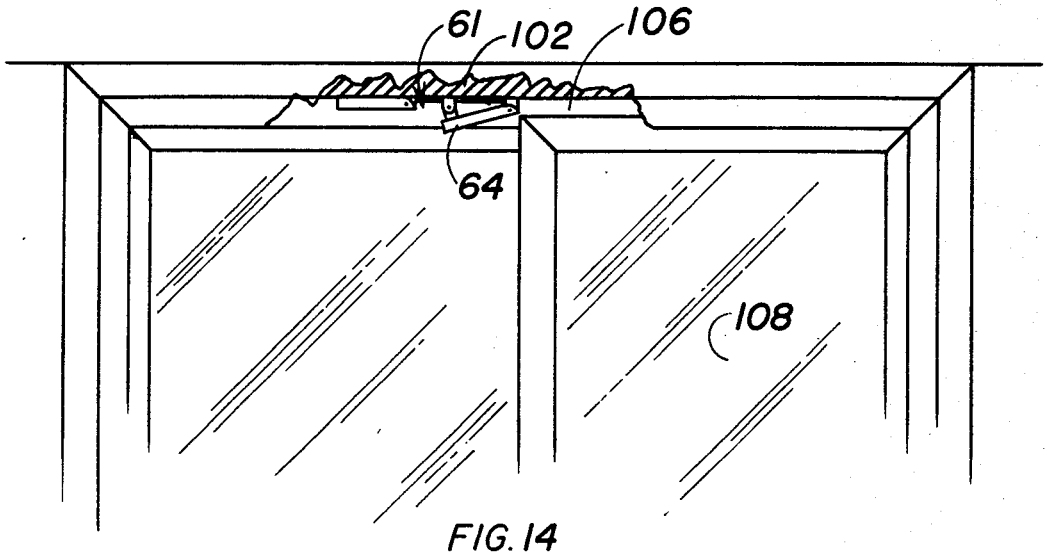
Figure 15:
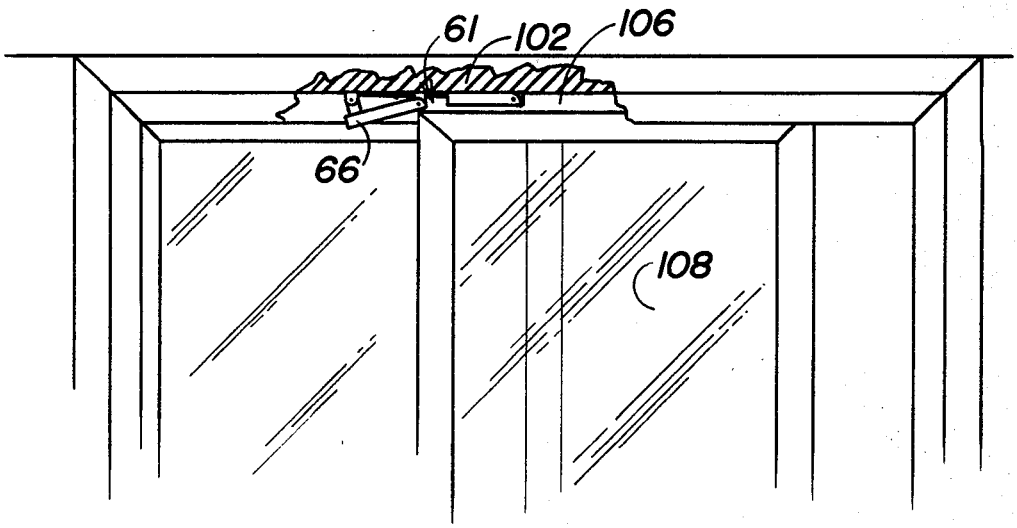

With reference to FIGS. 13-15, the operation of the second embodiment is similar to that of the first embodiment. A device 61 is attached to the top 102 of the upper track 104.

When both wedging members are closed, as shown in FIG. 13, the device 61 fits within space 106 between the top of sliding door or window 108 and top 102 of the upper track. As seen in FIG. 14, when first wedging member 64 is moved to its open, wedging position the sliding door is wedged shut. As seen in FIG. 15, when the first wedging member is closed and the second wedging member 66 is in its open, wedging position the door 108 can open a limited amount.

L-shaped tool 59 is particularly well adapted for use with this second embodiment. The bent end of the tool can be used to pull down on the wedging members so that the propping members can swing into their locked positions. When closing the device the bent end of the tool can be used to simultaneously pull down on a wedging member and pivot the associated propping member past the locking tang and its overcenter position, at which time the spring will finish the closing of the device.

Other embodiments for the L-shaped tool are possible, including a rod having a hooked end. In fact, any elongated implement having and end section adapted to engage the wedging member and/or pivot the propping member away from its overcenter position can be used to facilitate the opening and closing the present device.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A collapsible wedge assembly for sliding doors and windows provided with a sliding closure and an upper track for guiding the closure, said collapsible wedge assembly comprising:

an elongated base adapted to be attached to the upper track;

a first pivot means;

at least a first elongated wedging member attached to said elongated base by said first pivot means for pivoted movement towards said elongated base to a closed position and away from said elongated base to an open closure-wedging position, wherein said elongated wedging member is urged toward a closed position by a force tending to open the closure, and exerts a downwardly directed force on the sliding closure;

at least a first torsion spring means mounted on said first pivot means and continuously urging said elongated wedging member from said open position toward said closed position;

second pivot means; and, at least a first prop member attached to said elongated base by said second pivot means and normally biased by the force of gravity away from said elongated base to an overcenter position when said elongated wedging member is moved to open, closure-wedging position, to prop said elongated wedging member in said open, closure-wedging position, and to resist movement of said wedging member to a closed position by said spring means.

2. A collapsible wedge assembly as recited in claim 1, further comprising at least a first locking tang means disposed on said elongated wedging member for retaining said prop member in said over center position.

3. A collapsible wedge assembly as recited in claim 2, wherein said elongated wedging member is a channel-shaped member having a base portion and a pair of side wall portions, and said elongated base comprises a web portion and a pair of side wall portions, said elongated base being adapted to nestle within said closure-wedging member when said closure-wedging member is in said closed position.

4. A collapsible wedge assembly as recited in claim 3, further comprising means limiting the open, closure-wedging position of said elongated wedging member, and means limiting the overcenter position of said prop member.

5. A collapsible wedge assembly as recited in claim 4, wherein at least one aperture is provided through said base, at least one fastener is provided which is adapted to be disposed through said aperture to secure said elongated base to said upper track, and an aperture is provided in said elongated closure-wedging member to provide access to said fastener by a tool.

6. A collapsible wedge assembly as recited in claim 2, further comprising:

a third pivot means;

a second elongated wedging member spaced from said first elongated wedging member and in alignment therewith and attached by said third pivot means to said elongated base for pivotal movement towards said elongated base to a closed position and away from said elongated base to an open closure-wedging position, wherein said second elongated wedging member when in open, closure-wedging position is urged toward a closed position by a force tending to open the closure, and exerts a downwardly directed force on the sliding closure;

second torsion spring means mounted on said third pivot means and continuously urging said second elongated wedging member from said open position toward said closed position;

fourth pivot means;

a second prop member attached to said elongated base by said fourth pivot means and normally biased by the force of gravity away from said elongated base to an overcenter position when said second elongated wedging member is moved to open, closure-wedging position to prop said second elongated wedging member in said open, closure-wedging position, and to resist movement of said second wedging member to a closed position by said second spring means; and, second locking tang means disposed on said second elongated wedging member for retaining said second prop member in said overcenter position.

7. A collapsible wedge assembly as recited in claim 6, wherein said first elongated wedging member and said second elongated wedging member are channel-shaped members each having a base portion and a pair of side wall portions, and wherein said elongated base comprises an elongated web provided with side wall portions providing pivotal support for said elongated wedging members and said prop members.

8. The collapsible wedge assembly as recited in claim 7, wherein said first elongated wedging member lies in closed position disposed between said sliding closure and said upper track when said sliding closure is in abutting position against said second elongated wedging member.

9. A collapsible wedge assembly as recited in claim 8, wherein at least one aperture is provided through said base, and at least one fastener is provided which is adapted to be disposed through said aperture to secure said base to upper track.

* * * * *